US009217334B2

(12) United States Patent
Harris, Jr. et al.

(10) Patent No.: US 9,217,334 B2
(45) Date of Patent: Dec. 22, 2015

(54) TURBINE COVER PLATE ASSEMBLY

(75) Inventors: John Wesley Harris, Jr., Greenville, SC (US); Gary Charles Liotta, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1057 days.

(21) Appl. No.: 13/281,641

(22) Filed: Oct. 26, 2011

(65) Prior Publication Data

US 2013/0108462 A1 May 2, 2013

(51) Int. Cl.

*F01D 5/02* (2006.01)
*F01D 5/30* (2006.01)
*F01D 11/00* (2006.01)

(52) U.S. Cl.

CPC ..... *F01D 5/3015* (2013.01); *F01D 11/006* (2013.01); *F05D 2230/64* (2013.01); *Y10T 29/49321* (2015.01)

(58) Field of Classification Search

CPC ..... F04D 29/4213; F04D 29/4273; F04D 29/444; F04D 29/448; F04D 29/542; F04D 29/548

USPC ..... 416/204 A, 218, 220 R, 244 A, 244 R

See application file for complete search history.

(56) References Cited

U.S. PATENT DOCUMENTS

| | | | | |
|---|---|---|---|---|
| 3,741,681 | A * | 6/1973 | De Witt | 416/95 |
| 4,192,633 | A * | 3/1980 | Herzner | 416/221 |
| 4,480,958 | A | 11/1984 | Schlechtweg | |
| 4,480,959 | A * | 11/1984 | Bourguignon et al. | 416/220 R |
| 5,030,063 | A | 7/1991 | Berger | |
| 5,257,909 | A * | 11/1993 | Glynn et al. | 416/220 R |
| 8,105,041 | B2 | 1/2012 | Brillert et al. | |
| 8,226,365 | B2 | 7/2012 | Roush et al. | |
| 8,226,366 | B2 | 7/2012 | Bruecher et al. | |
| 8,277,191 | B2 | 10/2012 | Ammann | |
| 8,696,320 | B2 * | 4/2014 | Harris et al. | 416/248 |
| 2005/0281667 | A1 * | 12/2005 | Liang | 415/115 |
| 2008/0181767 | A1 | 7/2008 | Brillert et al. | |
| 2009/0022592 | A1 | 1/2009 | Liotta et al. | |
| 2009/0148298 | A1 * | 6/2009 | Strohl et al. | 416/219 R |
| 2010/0178160 | A1 | 7/2010 | Liotta et al. | |
| 2010/0196164 | A1 | 8/2010 | Liotta et al. | |

(Continued)

FOREIGN PATENT DOCUMENTS

| | | | |
|---|---|---|---|
| CN | 101220756 | A | 7/2008 |
| CN | 101258305 | A | 9/2008 |

(Continued)

OTHER PUBLICATIONS

U.S. Appl. No. 12/652,166, filed Jan. 5, 2010, Hafner.

(Continued)

*Primary Examiner* — Igor Kershteyn
*Assistant Examiner* — Woody A Lee, Jr.
(74) *Attorney, Agent, or Firm* — Sutherland Asbill & Brennan LLP

(57) ABSTRACT

The present application provides a cover plate assembly for use with a rotor disk. The cover plate assembly may include a radial flange extending from the rotor disk, a flange aperture extending through the radial flange, a cover plate segment with a fastening aperture and a hook for receiving the radial flange, and a fastener extending through the flange aperture and the fastening aperture.

18 Claims, 3 Drawing Sheets

(56) References Cited

U.S. PATENT DOCUMENTS

| | | | |
|---|---|---|---|
| 2010/0232938 | A1 | 9/2010 | Harris, Jr. et al. |
| 2010/0232939 | A1 | 9/2010 | Piersall et al. |
| 2010/0254805 | A1 | 10/2010 | Garcia-Crespo et al. |

FOREIGN PATENT DOCUMENTS

| | | | |
|---|---|---|---|
| CN | 101818659 | A | 9/2010 |
| CN | 101929357 | A | 12/2010 |
| EP | 0441424 | A1 | 8/1991 |
| EP | 0463955 | A1 | 1/1992 |
| EP | 2216505 | A2 | 8/2010 |
| EP | 2236768 | A2 | 10/2010 |
| GB | 2244100 | A | 11/1991 |

OTHER PUBLICATIONS

Search Report and Written Opinion from EP Application No. 12189571.8 dated Mar. 14, 2013.

Unofficial English Translation of Chinese Office Action issued in connection with corresponding CN Application No. 201210417105.8 on Apr. 1, 2015.

* cited by examiner

TURBINE COVER PLATE ASSEMBLY

TECHNICAL FIELD

The present application and the resultant patent relate generally to gas turbine engines and more particularly relate to a segmented turbine cover plate assembly for covering cooling air leakage paths so as to reduce cooling air leakage and improve overall performance.

BACKGROUND OF THE INVENTION

Generally described, gas turbine engines combust a mixture of compressed air and compressed fuel to produce hot combustion gases. The hot combustion gases may flow through one or more turbine stages to drive a load and/or a compressor. A pressure drop may occur between stages. The pressure drop may promote a flow of fluid, such as bucket or blade cooling air, to leak through unintended paths. As a result, cover plates may be disposed about the turbine wheels so as to reduce the leakage flow therethrough.

Known cover plates are generally retained by the buckets with grooved appendages thereon. Tabs or pins may be used to retain the cover plate thereon. These small retention features, however, may make it difficult to assemble or disassemble the cover plate. As such, known cover plates may be time consuming to install and/or replace.

There is thus a desire for an improved turbine cover plate design and methods of installing the same. The cover plate preferably will provide effective sealing so as to reduce cooling air leakage and therefore improve overall system efficiency and performance.

SUMMARY OF THE INVENTION

The present application and the resultant patent thus provide a cover plate assembly for use with a rotor disk. The cover plate assembly may include a radial flange extending from the rotor disk, a flange aperture extending through the radial flange, a cover plate segment with a fastening aperture and a hook for receiving the radial flange, and a fastener extending through the flange aperture and the fastening aperture.

The present application and the resultant patent further provide a method of preventing cooling leakage from a rotor disk. The method may include the steps of positioning a cover plate segment across a number of blade retaining slots of the rotor disk, supporting the cover plate segment by a radial flange of the rotor disk positioned within a hook of the cover plate segment, rotating the rotor disk, and blocking one or more gaps through the blade retaining slots.

The present application and the resultant patent further provide a cover plate assembly for use about a disk post of a rotor disk. The cover plate assembly may include a radial flange extending from the disk post, a flange aperture extending through the radial flange, a number of cover plate segments with a fastening aperture and a hook for receiving the radial flange, and a fastener extending through the flange aperture and the fastening aperture.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
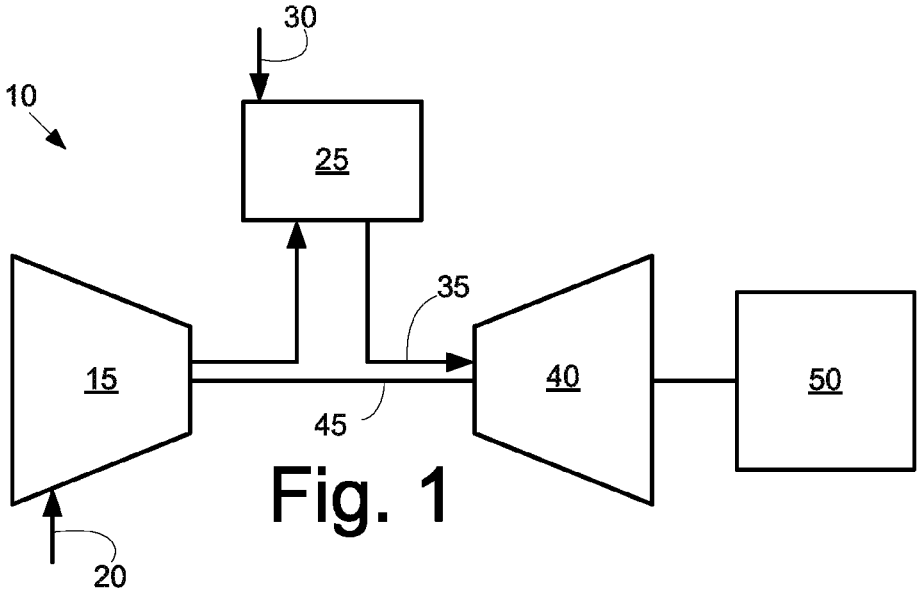
FIG. 1 is a schematic view of a gas turbine engine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be anyone of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
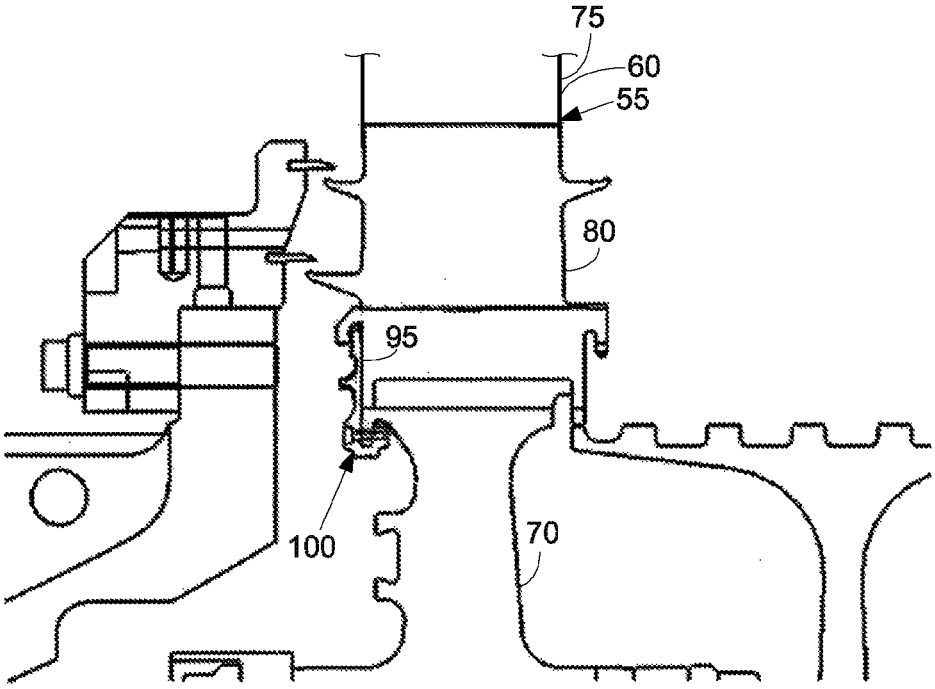
FIG. 2 is a side view of a number of turbine stages with a cover plate assembly as may be described herein.
Figure 3:
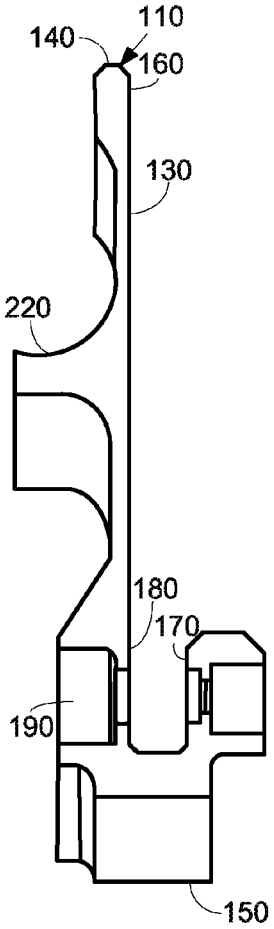
FIG. 3 is a perspective view of a cover plate as may be used with the cover plate assembly of FIG. 2.
Figure 4:
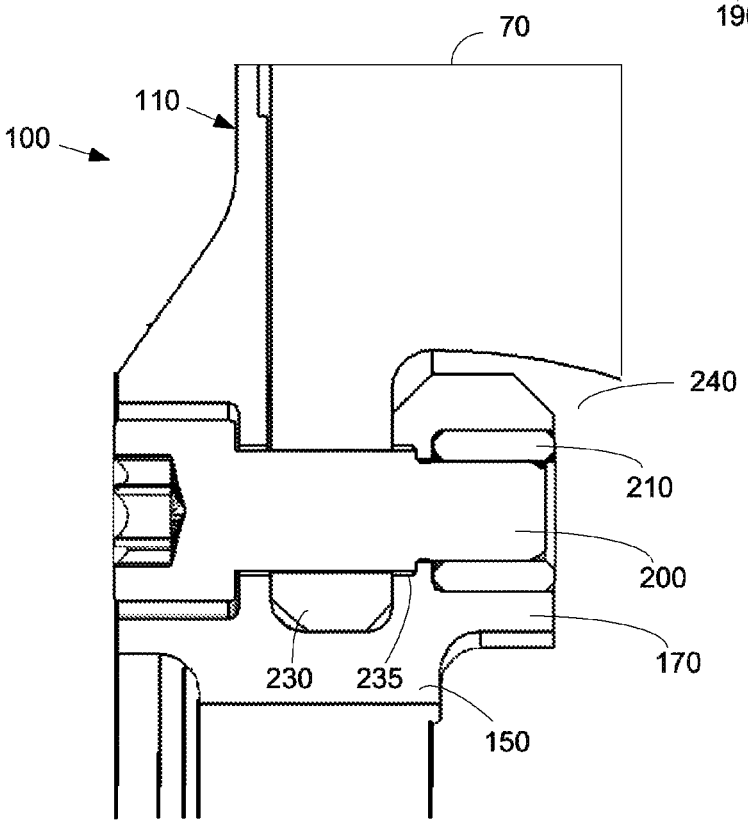
FIG. 4 is a side cross-sectional view of a portion of the cover plate assembly of FIG. 2.
Figure 5:
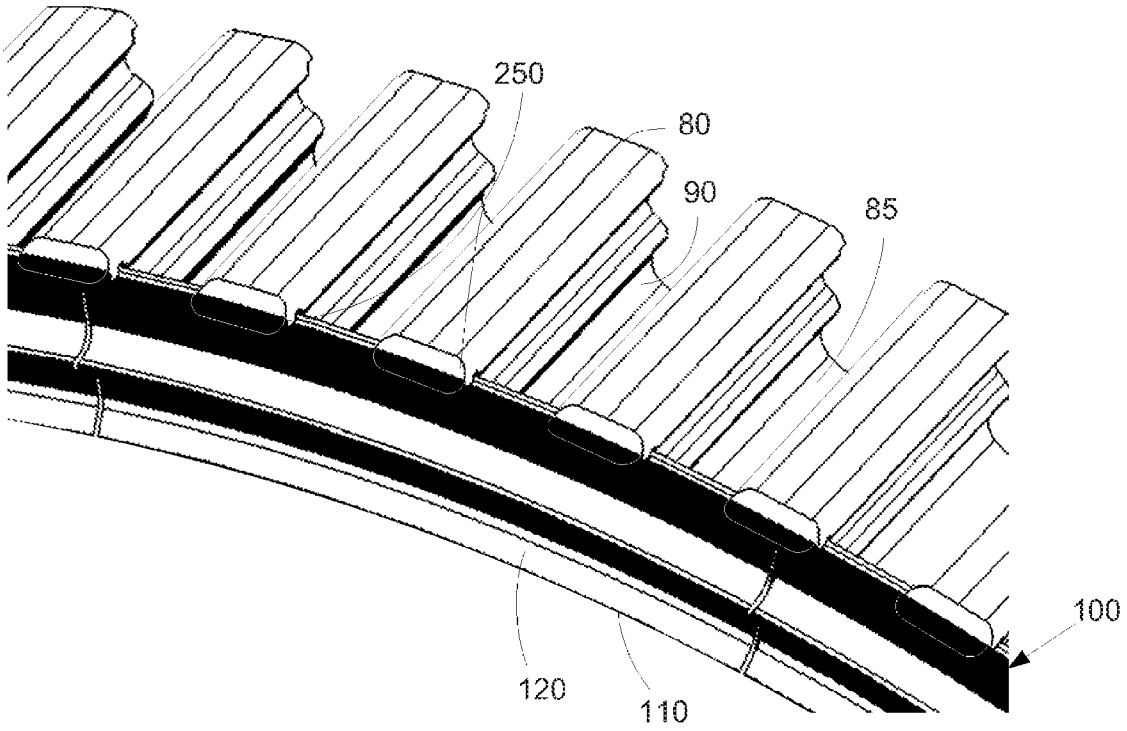
FIG. 5 is a perspective view of the cover plate assembly of FIG. 2.

FIG. 2 shows a number of stages 55 of the turbine 40. Although a first stage 60 is shown, any number of stages 55 may be used herein. Each stage 55 may include a rotor disk 70. The rotor disk 70 may be attached to the shaft 45 for rotation therewith. A number of blades or buckets 75 may be removably attached to a disk post 80 (see FIG. 5). The disk post 80 may include a number of blade retaining slots 85. The blade retaining slots 85 may include dovetails to interface with complementary dovetails on the ends of the buckets 75. When the buckets 75 are inserted within the slots 85, a gap 90 may exist at interfaces therebetween. Bucket or blade cooling air or wheel space purge flow may escape through these gaps 90. As described above, cover plates thus may be positioned about a face 95 of the blade retaining slots 85 to block the leakage flow therethrough In order to prevent leakage in this example, a cover plate assembly 100 as is shown in FIGS. 3-5 may be used herein. The cover plate assembly 100 includes a number of cover plate segments 110. The cover plate segments 110 axially overlay the faces 95 of the blade retaining slots 85 within the disk post 80. A series of cover plates segments 100 may be circumferentially positioned to overlay each of the blade retaining slots 85.

Each cover plate segment 110 may have a width 120. The width 120 may extend across the span of several blade retaining slots 85. In this example, each cover plate segment 110 may have the width 120 of about four (4) blade retaining slots 85 and buckets 75. A width 120 of any length, however, may be used herein. Each cover plate segment 110 may include a body 130 with a top portion 140 and a bottom portion 150. (The terms "top" and "bottom" refer to relative as opposed to absolute positions.) The top portion 140 may have a rim 160. When in position, the rim 160 may extend towards the disk post 80. The bottom portion 150 may have a hook 170. The hook 170 may have a substantial U-shape 180. The depth of the hook 170 may vary. The bottom portion 150 also may have a fastening aperture 190 extending through the hook 170 at about the middle of the width 120. The fastening aperture 190 may be sized for a conventional bolt 200 and nut 210. Other types of fastening means also may be used herein. One or more ribs 220 may be positioned between the top portion 140 and the bottom portion 150 of the body 130. The ribs 220 may extend outward in a direction away from the disk post 80. The cover plate segment 110 may be ring rolled, hot die forged, and/or other manufacturing techniques may be used. Other components and other configurations may be used herein.

The cover plate assembly 100 also may include components formed or added to several elements of the stages 55. Specifically, the rotor disk 70 may include a radial flange 230 extending from the disk post 80. The radial flange 230 may be sized to accommodate the hook 170 of the cover plate segment 110. A flange aperture 235 may extend through the radial flange 230 so as to accommodate the bolt 200 and the nut 210. A gap 240 also may extend between the radial flange 230 and the rotor disk 70 for access to the nut 210. The disk post 80 also may include a disk post hook 250. The disk post hook 250 may be sized to accommodate the top portion 140 of the cover plate segment 110 with the rim 160 thereon. Other components and other configurations may be used herein.

In use, each cover plate segment 110 is positioned about the rotor disk 70. The hook 170 of the cover plate segment 110 is positioned about the radial flange 230 of the rotor disk 70 while the top portion 140 of the cover plate segment 110 is positioned within the disk post hook 250 of the disk post 80. The bolt 200 is thus positioned through the fastening aperture 190 of the cover plate segment 110 and the flange aperture 235 of the radial flange 230 of the disk post 80. The nut 210 then may be applied and tightened. The fastening aperture 190 may be positioned in about the circumferential center of the cover plate segment 110. A cutout in the hook 170 may be sized for the nut 210 or other type of fastening means. The cover plate segment 110 thus may be connected directly and securely to the rotor disk 70. Other components and other configurations may be used herein.

Specifically, the hook 170 of the cover plate segment 110 supports and constrains the cover plate segment 110 in both radial and axial directions. The centrifugal loads from the rotating cover plate segments 110 are supported by the radial flange 230 in the radial direction. The axial pressure loads and bucket loads also are supported by the radial flange 230 in connection with the hook 170. Additional axial support may be provided by the cover plate segments 110 making contact with the face 95 of the blade retaining slots 85. The cover plate segment 110 also may be used to control the axial position of the buckets 75 relative to the rotor disk 70 by engaging the disk post hook 250.

The cover plate assembly 110 thus provides easy positioning and constraining of the cover plate segments 110 about the rotor disk 70 while also providing for good sealing. Moreover, the cover plate assembly 100 does not use the complex or small features of known cover plates that may be prone to damage. Any number of the cover plate segments 110 may be used with each rotor disk 70. Each cover plate segment 110 described herein is determinately supported by the rotor disk 70 in the radial and axial directions. Sealing is provided by axial contact against the disk post 80 without the need for seals between the cover plate segments 110. Further, the radial load for each cover plate segment 110 is taken by the hook 170 as opposed to the bolts 200. Rather, the bolt 200 provides anti-rotation support and keeps the cover plate segment 110 in position when the disk 70 is not rotating. The cover plate assembly 100 thus provides low cost but robust sealing with easy assembly and disassembly.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A cover plate assembly for use with a rotor disk, comprising:

a radial flange of the rotor disk;

a flange aperture extending through the radial flange;

a cover plate segment;

the cover plate segment comprising a fastening aperture, a hook for receiving the radial flange, and a rim;

a fastener extending through the flange aperture and the fastening aperture; and a disk post of the rotor disk;

the disk post comprising a disk post hook for receiving the rim and supporting the cover plate segment in an axial direction.

2. The cover plate assembly of claim 1, wherein the radial flange extends from the disk post.

3. The cover plate assembly of claim 1, wherein the disk post comprises a plurality of blade receiving slots, and wherein the cover plate segment comprises a width of a plurality of blade receiving slots.

4. The cover plate assembly of claim 3, wherein the width comprises four (4) blade receiving slots.

5. The cover plate assembly of claim 1, wherein the disk post comprises a face, and wherein the cover plate segment comprises a body in contact with the face.

6. The cover plate assembly of claim 1, further comprising a plurality of cover plate segments.

7. The cover plate assembly of claim 1, wherein the fastener comprises a nut and a bolt.

8. The cover plate assembly of claim 1, wherein the hook comprises a substantial U-shape.

9. The cover plate assembly of claim 1, wherein the cover plate segment comprises one or more ribs thereon.

10. The cover plate assembly of claim 1, wherein the rotor disk is positioned within a first turbine stage.

11. The cover plate assembly of claim 1, further comprising an axial gap defined between the radial flange and a base of the rotor disk.

12. The cover plate assembly of claim 1, wherein the hook and the radial flange provide radial and axial support to the cover plate segment.

13. The cover plate assembly of claim 1, wherein the fastener provides anti-rotation support for the cover plate segment.

14. A method of preventing cooling leakage from a rotor disk, comprising:

positioning a cover plate segment across a plurality of blade retaining slots of a disk post of the rotor disk;

supporting the cover plate segment in a radial direction and an axial direction by a radial flange of the disk post positioned within a hook of the cover plate segment;

supporting the cover plate segment in the axial direction by a rim of the cover plate segment positioned within a disk post hook of the disk post;

securing the cover plate segment by a fastener extending through a flange aperture of the radial flange and a fastening aperture of the cover plate segment;

rotating the rotor disk; and blocking one or more gaps through the plurality of blade retaining slots with the cover plate segment.

15. A cover plate assembly for use about a disk post of a rotor disk, comprising:

a radial flange of the disk post;

a plurality of flange apertures extending through the radial flange;

a plurality of cover plate segments;

each of the plurality of cover plate segments comprising a fastening aperture, a hook for receiving the radial flange, and a rim;

a plurality of fasteners;

each of the plurality of fasteners extending through one of the flange apertures and the fastening aperture of one of the plurality of cover plate segments; and a plurality of disk post hooks of the disk post for receiving the rims of the cover plate segments and supporting the cover plate segments in an axial direction.

16. The cover plate assembly of claim 15, wherein the disk post comprises a plurality of blade receiving slots, and wherein each of the plurality of cover plate segments comprises a width of a plurality of blade receiving slots.

17. The cover plate assembly of claim 15, wherein the disk post comprises a face, and wherein each of the plurality of cover plate segments comprises a body in contact with the face.

18. The cover plate assembly of claim 15, wherein each of the plurality of cover plate segments comprises one or more ribs thereon.

* * * * *